US007047860B2

(12) United States Patent
Faborsky

(10) Patent No.: US 7,047,860 B2
(45) Date of Patent: May 23, 2006

(54) SAFETY MOUNTAINEERING ROPE AND MANUFACTURING METHOD THEREFOR

(75) Inventor: Radek Faborsky, Semily (CZ)

(73) Assignee: Singing Rock, Ltd., Ponikla (CZ)

( * ) Notice: Subject to any disclaimer, the term of this patent is extended or adjusted under 35 U.S.C. 154(b) by 80 days.

(21) Appl. No.: 10/145,781

(22) Filed: May 16, 2002

(65) Prior Publication Data

US 2002/0170417 A1 Nov. 21, 2002

(30) Foreign Application Priority Data

May 16, 2001 (CZ) ..... PV 2001-1715

(51) Int. Cl.
*D04C 1/06* (2006.01)

(52) U.S. Cl. ..... 87/6; 87/9; 87/29

(58) Field of Classification Search ..... 87/6, 87/9, 29

See application file for complete search history.

(56) References Cited

U.S. PATENT DOCUMENTS 3,960,050 A * 6/1976 Eisler ..... 87/1
3,968,725 A * 7/1976 Holzhauer ..... 87/6
4,170,921 A 10/1979 Repass
4,271,329 A * 6/1981 Perelmuter ..... 174/84 R
4,311,079 A * 1/1982 Hood ..... 87/6
4,640,178 A 2/1987 Kurzböck
4,886,691 A * 12/1989 Wincklhofer ..... 428/68
5,060,549 A 10/1991 Beal
5,242,743 A * 9/1993 Nakanishi et al. ..... 428/222
5,322,049 A * 6/1994 Dunlap ..... 124/90
5,485,774 A * 1/1996 Osborne ..... 87/6
5,580,627 A * 12/1996 Goodwin et al. ..... 428/36.3
5,934,168 A * 8/1999 Feichtinger et al. ..... 87/8
6,050,077 A 4/2000 Müller

FOREIGN PATENT DOCUMENTS

DE 1828967 3/1961

OTHER PUBLICATIONS www.yalecordage.com, Miniline, Nov. 26, 2001.*

* cited by examiner

*Primary Examiner*—John J. Calvert
*Assistant Examiner*—Shaun R Hurley
(74) *Attorney, Agent, or Firm*—Buchanan Ingersoll PC

(57) ABSTRACT

A mountaineering rope (7) with the diameter 10.1 mm to 10.8 mm characterized in that the core (8) made from such number of yarns being necessary for achieving required static strength and resistance to dynamic stress. A braiding (9) around the core (8) is made using a circular braiding machine with 44 carrier, and from yarn having linear density 1500 dtex to 6000 dtex on each carrier.

9 Claims, 2 Drawing Sheets

Prior Art

SAFETY MOUNTAINEERING ROPE AND MANUFACTURING METHOD THEREFOR

FIELD OF THE INVENTION

The present invention relates to a mountaineering rope construction and manufacturing method therefor.

BACKGROUND OF THE INVENTION

For mountain climbing purpose, dynamic ropes with diameter of 10.1 mm to 10.8 mm made of synthetic fibres are mostly used. Important features of the mountaineering rope (further only rope) are light weight and thin diameter, static strength, resistance to dynamic stress and wear resistance for which the thickness of the rope braiding is crucial. The rope with standard diameter has a core involving the number of yarns consistent with both the static strength and the resistance to dynamic stress required. The rope braiding has been made using a circular braiding machine having 48 carrier used in pairs, so-called tandem. Each carrier carries a yarn with the linear density of 3300–5000 dtex. The system with 48 carrier, where each of them is the carrier of one yarn, is the most suitable for making the rope with diameter 10.1 mm to 10.8 mm. The rope like this has the diameter required and thickness of the braiding which is necessary for harder wear resistance of the rope. A disadvantage of these ropes is their heavier weight.

With the aim of reducing the rope weight, compared with the standard rope above mentioned, the rope diameter has to be reduced. Then the number of core yarns is chosen so that to achieve the necessary static strength and resistance to dynamic stress. The rope braiding has been made using the circular braiding machine having 48 carrier used in pairs, so called tandem. Each carrier carries a yarn with the linear density of 2500 dtex to 3800 dtex, which allows creating the inner diameter of the braiding corresponding with the core diameter. The rope like this has the sufficient static strength and resistance to dynamic stress, light weight, compact construction and thinner diameter than the standard rope. Its disadvantage is small thickness of the rope braiding as well as the low wear resistance of the rope resulting in its shorter lifetime.

SUMMARY OF A PREFERRED THE INVENTION

Above mentioned disadvantages can be eliminated by the mountaineering rope having the diameter 10.1 mm to 10.8 mm made according to a preferred embodiment of the present invention. Its nature is that the rope core consisting braided or twisted cords and having such number of yarns so as to achieve the necessary static strength and resistance to dynamic stress of the rope, has the same diameter as the core of the standard rope with lighter weight. The rope braiding is made using the circular braiding machine having 44 carrier used in pairs, so-called the tandem. Each carrier carries a yarn having the linear density 1500 dtex to 6000 dtex. The rope braiding has the same thickness as the standard rope braiding.

The method of making the mountaineering rope according to a preferred embodiment of the comprises manufacturing a core from braided or twisted cords having the number of yarns necessary for obtaining required static strength and resistance to dynamic stress. Its diameter is the same as the diameter of the standard rope with lighter weight. Then using the circular braiding machine with 44 carrier used in pairs, so-called the tandem, the rope braiding is made around the core having the same thickness as the thickness of the standard rope braiding. The yarn on each carrier has the linear density 1500 dtex to 6000 dtex. Each carrier is the carrier of one, two or three yarns.

The rope according to a preferred embodiment of the invention has necessary static strength and resistance to dynamic stress, satisfactory compactness of the core and braiding design, light weight and harder wear resistance resulting in the long lifetime.

DESCRIPTION OF THE PREFERRED EMBODIMENT

Figure 1:
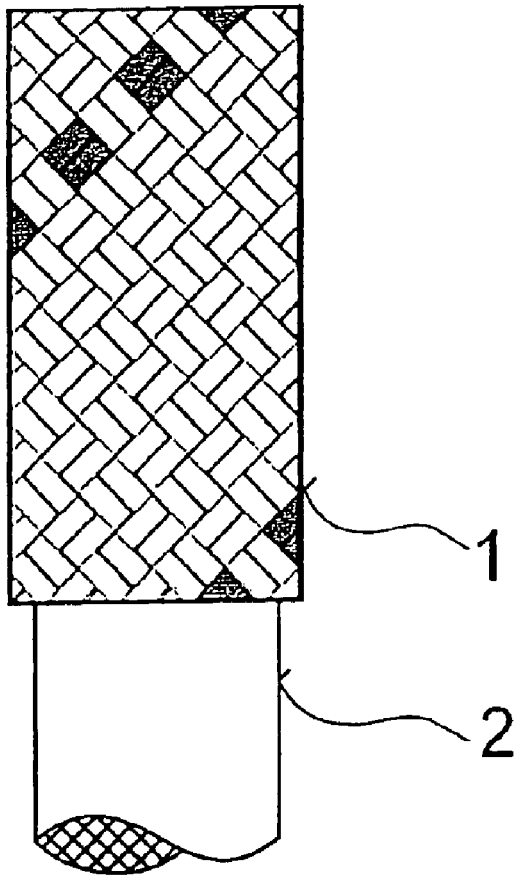
Fig. 1 Prior Art
FIG. 1 of the attached drawing shows a front view.

The standard rope 1 with the diameter $D_1$=10.1–10.8 mm (FIG. 1) has the core 2 formed by braided or twisted cords consisting of such number of yarns consistent with required static strength and resistance to dynamic stress of the rope 1. The rope braiding 3 is made around the core 2 with the diameter d, using the circular braiding machine having 48 carrier needles in pair, so-called the tandem, from yarn with the linear density of 3300 dtex up to 5000 dtex on each carrier. Sufficient thickness $t_1$ of the braiding 3 provides necessary wear resistance of the rope 1.

Figure 2:
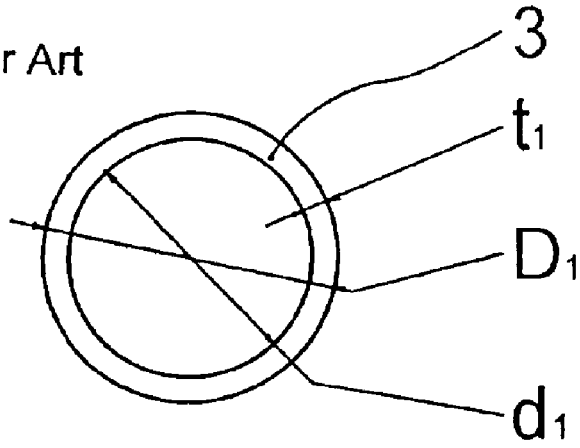
FIG. 2 shows a plan view of the standard rope.

In FIG. 2 the standard rope with lighter weight 4 is presented. The core 5 of the standard rope with lighter weight 4 formed by braided or twisted cords has the diameter $d_2=d_1-x$ which is smaller by the value of x than the diameter $d_1$ of the core 2 of the standard rope 1. The braiding 6 around the core 5 has the thickness $t_2=t_1-y$ being by the value of y smaller than the thickness $t_1$ of the braiding 3 of the standard rope 1. The rope braiding 6 is made using the circular braiding machine having 48 carrier in pair, so-called the tandem, from yarn with the linear density 2500 dtex to 3800 dtex on each carrier. The number of yarns in the core 5 is chosen so that to achieve necessary static strength and resistance to dynamic stress of the rope 4. The diameter $D_2$ of the standard rope with lighter weight 4 is smaller than the diameter $D_1$ of the standard rope 1 ($D_2=D_1-x-2y$). The standard rope with lighter weight 4 achieves necessary strength, light weight and construction compactness. Its disadvantage is the low thickness $t_2$ of the braiding 6 with which lower wear resistance of the rope 4 is connected and subsequently also shorter lifetime of the rope 4.

Figure 3:
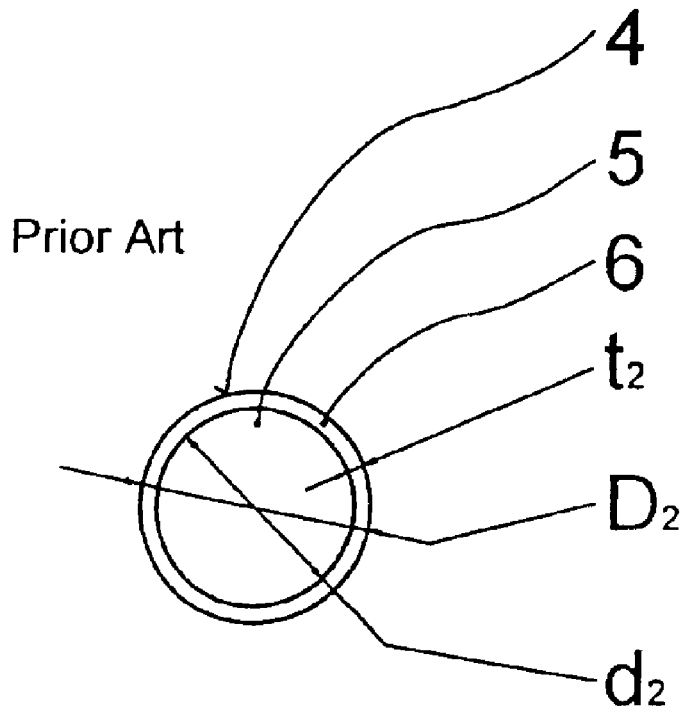
FIG. 3 represents a plan view of the standards rope with lower weight.
Figure 4:
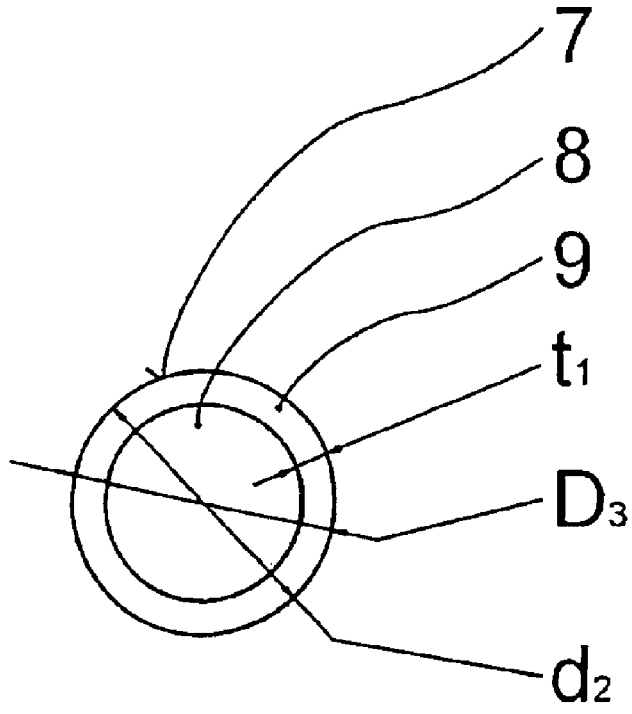
FIG. 4 shows a plan view of the rope according to a preferred embodiment of the invention.

Mountaineering rope 7 according to a preferred embodiment of the invention (FIG. 3) has the core 8 formed by braided or twisted cords, and the diameter $d_2$ is the same as the diameter of the core 5 of the standard rope with light weight 4. The number of yarns of the core 8 is chosen so as to achieve necessary static strength and resistance to dynamic stress of the rope 7. The rope braiding 9 around the core 8 has the thickness $t_1$, and it is made using the circular braiding machine having 44 carrier in pairs (the tandem), and the linear density of yarn on each carrier is 4000 dtex. The diameter $D_3$ of the rope 7 is smaller than the diameter $D_1$ of the standard rope 1 ($D_3=D_1-x$). Taking into account that the rope braided 9 is braided using 44 carrier from the yarn given linear density, the rope 7 has both the high static strength and the high resistance to dynamic stress, the compact construction of the core 8 with the braiding 9 thinner diameter and lighter weight than the standard rope, and under the influence of the thickness $t_1$, of the braiding 9 achieved, it also has the high wear resistance and long lifetime.

THE INDUSTRIAL APPLICABILITY

The rope design according to the invention will also have an application in speleology, in works on high or above free depth, in rope access and rescue.

What is claimed is:

1. A mountaineering rope with an outer diameter of between 10.1 mm to 10.8 mm having a core formed by braided or twisted cords made from synthetic fibers, the rope characterized in that yarn is braided around the core using a circular braiding machine with 44 carrier, the yarn on each carrier has a linear density of between 1500 dtex to 6000 dtex.

2. A method for making rope having a diameter ranging from about 10.1 mm to about 10.8 mm and having adequate static strength and resistance to dynamic stress, comprising:

making a core that extends substantially the entire length of the rope from yarn;

weaving a sheath that substantially encases and substantially contacts the entire length of the core, the sheath being woven from yarn having linear density 1500 dtex to 6000 dtex using a circular braiding machine with 44 carriers;

wherein the yarn is on each of the 44 carriers.

3. The method of claim 2, further comprising using the 44 carriers in pairs.

4. The method of claim 2, further comprising braiding cords made of synthetic fibers to make the core.

5. The method of claim 2, further comprising twisting cords made of synthetic fibers to make the core.

6. The method of claim 2, wherein the yarn is made from synthetic material.

7. The method of claim 2, wherein the core extends substantially the entire length of the rope.

8. The method of claim 2, wherein the sheath substantially encases the entire length of the rope.

9. The method of claim 2, wherein the sheath contacts substantially the entire length of the core.

* * * * *